United States Patent [19]

Cheney et al.

[11] Patent Number: 4,687,510

[45] Date of Patent: Aug. 18, 1987

[54] METHOD FOR MAKING ULTRAFINE METAL POWDER

[75] Inventors: Richard F. Cheney, Sayre; Richard H. Pierce, Towanda, both of Pa.

[73] Assignee: GTE Products Corporation, Stamford, Conn.

[21] Appl. No.: 827,566

[22] Filed: Feb. 10, 1986

Related U.S. Application Data

[63] Continuation of Ser. No. 581,522, Feb. 21, 1984, Pat. No. 4,592,781.

[51] Int. Cl.[4] ..... C22C 1/04

[52] U.S. Cl. ..... 75/0.5 B; 75/0.5 BA; 75/0.5 BB; 75/68 R; 75/251; 148/11.5 A; 148/126.1; 264/8; 264/12; 264/82

[58] Field of Search ..... 75/0.5 B, 0.5 BB, 0.5 BA, 75/68 R, 249, 228, 236, 251; 419/17, 23, 30, 31, 38, 42, 48, 49; 148/11.5 A, 126.1; 264/8, 12, 82; 420/528, 532

[56] References Cited

U.S. PATENT DOCUMENTS 4,592,781 6/1986 Cheney et al. ..... 75/249

*Primary Examiner*—Stephen J. Lechert, Jr.
*Attorney, Agent, or Firm*—Robert E. Walter

[57] ABSTRACT

A fine aluminum metallurgical powder suitable for compacting and sintering into densified articles which includes a dispersed phase is produced by directing a stream of molten droplets at a repellent surface to produce smooth surfaced and melt solidified particles having an average particle size of less than about ten micrometers.

1 Claim, 1 Drawing Figure

METHOD FOR MAKING ULTRAFINE METAL POWDER

This application is a continuation of application Ser. No. 581,522, filed Feb. 21, 1984, now U.S. Pat. No. 4,592,781.

FIELD OF INVENTION

The present invention relates to a process for making rapidly cooled fine metal powders.

BACKGROUND OF THE INVENTION

U.S. Pat. No. 3,646,177 to Thompson discloses a method for producing powdered metals and alloys that are free from oxidation by a process which involves atomizing molten metal with a fluid jet to form discrete particles of the molten metal. The jet is directed into a reservoir of an inert cryogenic liquid to solidify the particles and prevent oxidation during cooling.

U.S. Pat. No. 4,069,045 to Lundgren describes a process wherein a jet of molten metal is impinged against a rotating flat disc. Relatively thin, brittle, easily shattered, and essentially dentrite free metal flakes are obtained. These flakes are also described in U.S. Pat. No. 4,063,942 to Lundgren.

U.S. Pat. No. 4,221,587 to Ray relates to a method of making powder by impinging a jet of molten alloy at an acute angle against the inner surface of a rotating cylindrical chill body. As set forth in column 5, the impinging molten breaks into a stream of discrete droplets which bounce off the surface and move in the direction of the chill surface. Upon impact with the chill surface, the droplets are solidified at a rapid As set forth in column 6, "the glassy metal powder particles ... have relatively sharp notched edges which enable the particles to interlock during compaction". As set forth in the first example, the particle size of the powder is such that 90% of the particles have a particle size range between about 25 and 300 microns. In the second example, the particle size of the powder ranges between 100 and 1000 microns.

Herbert Herman and Hareesh Bhat, in an article entitled "Metastable Phases Produced by Plasma Spraying" appearing in the proceedings of a symposium sponsored by the TMS-AIME alloy Phases Committee at the Fall meeting of the Metallurgical Society of AIME, Pittsburgh, Pa., Oct. 5–9, 1980 describes the high velocity deposition of plasma-melting particles on a substrate. On page 118, the article indicates that good physical and thermal contact should exist between the solidifying liquid and substrate. Liquid spreading occurs away from the impact point. As illustrated in the drawings, the particles have a flat surface adjacent the substrate with a central raised core region and a circular rim area.

DRAWINGS

SUMMARY OF INVENTION

Figure 1:
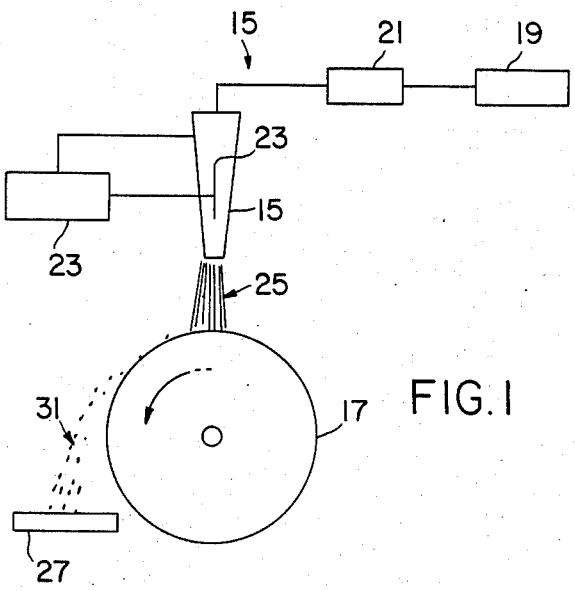
FIG. 1 is a schematic drawing of a device including a plasma spray apparatus and drum.

Atomized metal or metal alloy powders in the one to ten micrometer size range are desirable for many applications such as electrostatic copying and for rapid solidification processes. However, particles in this size range are very difficult to obtain. Standard atomization techniques, where a gas or liquid impinges a molten metal exiting an orifice, are not effective in producing particles in the above range. Agglomeration and plasma melting methods are also not effective since it is necessary to start with particles or agglomerates of about the same size as the ending particles. Agglomerates of very small size are difficult to form and uniformity in particle composition is even more difficult to obtain. In general, very fine powders are often high in atmosphere impurities such as oxygen, nitrogen or impurities from the grinding medium used to obtain the small size.

In accordance with the present invention, there is provided a fine powder wherein a substantial portion of the particles have smoothly curvilinear surfaces and an average particle size less than about ten micrometers.

Also, in accordance with the present invention, there is provided a process for making very fine metal powder. A high velocity stream of molten metal droplets is directed toward a repellent surface. The molten droplets are impacted against the surface to fragment the droplets and form still molten fragmented portions which are rapidly cooled to form a fine metal powder. The resulting powder comprises particles less than about ten micrometers with curvilinear surface.

DETAILED DESCRIPTION

High velocity streams of molten metal droplets may be formed by thermal spraying. A wide range of materials, both organic and inorganic may be thermally sprayed. Typical organic materials include high melting polymers such as high temperature aromatic polyester plastics. One such polymer is sold under the trade name EKONOL by the Carborundum Company. Inorganic materials for thermal spraying include ceramics and cermets.

The preferred powders are metals and metal alloys. Low melting metals or alloys may include zinc, lead, silver or gold. Higher melting point metals and alloys typically contain copper, cobalt, iron and nickel may be used. The refractory metals and alloys which typically have melting points in excess of 1800 degrees centirade are of particular interest. The refractory type metals include molybdenum, niobium, tungsten, tantalum, chromium alloys and mixtures thereof. The term metals include elemental metals, alloys, pure or mixed oxides, borides, carbides and nitrides of metal with or without additives.

Preferred metal powders of the present invention are aluminum metal powders. Preferred aluminum and aluminum alloy powders contain an additional component for forming a dispersed phase in a powdered metallurgical product prepared from the powder. According to powder metallurgical methods, powders are mixed, compacted into desired form and are densified by sintering to produce the powder metallurgical article. Further processing may include hot and cold working. The powders of the present invention consist essentially of smooth surfaced and melt solidifed particles having an average particle size of less than ten micrometers.

Additional alloying components may include components having a low solubility in aluminum. Although rapid solidificaion may result in the alloying elements being metastable in solution in the supersaturated state. Typical additional components include As, Au, Ba, B, Be, Bi, Ca, Ga, Ce, Cd, Co, Cr, Cu, Fe, Ge, Hf, Hg, In, K, Li, La, Na, Mn, Mg, Ni, Pb, Sb, Pd, Pr, Se, Pt, Sn, Si, Ti, Zn, Zr, V, U, W, Te,Ti or Th.

It is contemplated that the final metallurgical article comprise a dispersed and discrete phase even though this phase may not be present in the aluminum powders of the present invention. Such a discrete phase may not formed until subsequent solid state treatment of the article. Typical aluminum alloys are Al 8.0Zn-2.5 Mg-1.0 Cu-1.5 Co; Al-7.8 Fe-0.2Cr-0.2V: 0.2Ti-0.2 Zr,; Al-3.0 Li-1.5 Cu 0.5 Mo; Al-3.7 Ni-1.5 Fe; Al-4.5 Cu1.5 Mg-0.8 Mn-6.0 Ni and Al-5.6 Zn-2.5 Mg-1.6 Cu-0.3 Cr1.o Ni-1.0 Zr.

The dispersed phase for hardening or strengthening or strengthening the metal may be in the form of intermetallic compounds. Typical intermetallic compounds are Ni Al, Co Al, Fe Zn and Nb $Fe_2$. In this case, such compounds may be in the powder of the present invention as a separate phase. High melting point refractory particles such as oxides, silicides, borides, nitrides and carbides may be employed as the dispersed dispersed phase. Particularly suitable for a dispersed phase are the oxides, carbides, borides, silicides and nitrides of chromium, tungsten, molybdenum, vanadium, niobium, tantalum, zirconium, hafnium and oxides of aluminum, cerium, magnesium, zirconium, titanium and thorium. The dispersed phase is preferably about less than 10 percent by atomic weight.

Since the powders of the present invention are produced by rapid cooling, at least some of the powders contain particles having amorphous phases or metastable crystal structures. Metal alloys which are most easily obtained in the amorphous state by rapid quenching or by deposition techniques are mixtures of transition metals. The cooling rate necessary to achieve the amorphous state depends on the composition of the alloys.

Generally, there is a small range of compositions surrounding each of the known compositions where the amorphous state can be obtained. However, apart from quenching the alloys, no practical guideline is known for predicting with certainty which of the multitude of different alloys will yield an amorphous metal with given processing conditions. Examples of amorphous alloys formed by rapid quenching are described in U.S. Pat. No. 3,856,513 to Ohen et al, U.S. Pat. Nos. 3,427,154 and 3,981,722, as well as others.

The amorphous and crystalline state are distinguished most readily by differences in X-ray diffraction measurement. Diffraction patterns of an amorphous substance reveal a broad halo similar to a liquid. Crystalline materials produce a line or broadened line diffraction pattern. The amorphous alloys provided by the present invention appear to be liquid when studied from x-ray diffraction patterns, but the alloy is solid when studied in terms of hardness and viscosity. An amorphous alloy structure is inherently metastable, i.e., the state is non-equilibrium. Since the atoms of the amorphous structure are not arranged in a periodic array, there is at any temperature a tendency of the amorphous structure to transform toward the crystalline structure of the equilibrium state through diffusion or segregation of components of the alloy.

The rapidly cooled powder particles of the present invention preferably have a particle size distribution wherein at least about 80 percent of the particles have an average particle size less than about 10 microns. Depending on the composition and exact conditions of powder formation, even smaller particle size distributions wherein at least 90 percent of the particles have an average particle size less than about 10 microns may be formed. Another particle distribution includes greater than about 80 percent of the particles having average particle size greater than about 0.5 and less than about 8 microns.

The particles of the present invention are preferably cooled from ultrafine portions of molten materials to give a characteristic curvilinear surface to the particles. Due to surface tension, airborn molten material tends to contract until the smallest surface area consistent with its volume is occupied. Due to the repellent nature of the repellent surface droplet formation is favored. The tendency of the molten material is to form spheres. If the rapidly cooled particles solidify prior to assuming the shape of a sphere or molten particles collide during cooling, the molten portions may form elliptically shaped or elongated particles with rounded ends.

The powders of the present invention differ from milled or fractured powders which are characterized by an irregularly shaped outline which may have sharp or rough edges.

According to the Brunauer, Emmett and Teller (BET) method and equation for determining the surface area and diameter, the particles of the present invention exhibit BET diameters from about $\frac{1}{2}$ micrometers to about 10 micrometers.

A scanning Election Micrograph (SEM) photo of molybdenum powder of the present invention has particles which have substantially smoothly curvilinear surfaces. The particles appear as small blobs or globs which are spheroidally and ovoidally shaped with arcuate and curved surfaces. The particles comprise cells of from about 0.01 to about 0.1 micrometers which are indicative of rapid cooling.

In preparing the powders of the present invention, a high velocity stream of molten metal droplets is formed. Such a stream may be formed by any thermal spraying technique such as electric-arc spraying, combustion spraying and plasma spraying. Typically, the velocity of the molten droplets is greater than about 100 meters per second, preferably greater than about 200 meters per second, and more preferably greater than 250 meters per second. Velocities on the order of 900 meters per second or greater may be achieved under certain conditions which favor these speeds which may include spraying in a vacuum.

In the preferred process of the present invention, a powder is fed through a thermal spray apparatus. Feed powder is entrained in a carrier gas and then fed through a high temperature reactor. The temperature in the reactor is preferably above the melting point of the highest melting component of the metal powder and even more preferably above the vaporization point of the lowest vaporizing component of the material to enable a relatively short residence time in the reaction zone.

The stream of dispersed entrained molten metal droplets may be produced by plasma-jet torch or gun apparatus of conventional nature. Typical plasma jet apparatus is of the resistance arc or induction type. In general, a source of metal powder is connected to a source of propellant gas. A means is provided to mix the gas with the powder and propel the gas with entrained powder through a conduit communicating with a nozzle passage of the plasma spray apparatus. In the arc type apparatus, the entrained powder may be fed into a vortex chamber which communicates with and is coaxial with the nozzle passage which is bored centrally through the nozzle. In an arc type plasma apparatus, an electric arc is maintained between an interior wall of the nozzle passage and an electrode present in the passage. The electrode has a diameter smaller than the nozzle passage with which it is coaxial to so that the gas is discharged from the nozzle in the form of a plasma jet. The current source is normally a DC source adapted to deliver very large currents at relatively low voltages. By adjusting the magnitude of the arc power and the rate of gas flow, torch temperatures can range from 150 degrees centigrade up to about 15,000 degrees centigrade. The apparatus generally must be adjusted in accordance with the melting point of the powders being sprayed and the gas employed. In general, the electrode may be retracted within the nozzle when lower melting powders are utilized with an inert gas such as nitrogen while the electrode may be more fully extended within the nozzle when higher melting powders are utilized with an inert gas such as argon.

In the induction type plasma spray apparatus, metal powder entrained in an inert gas is passed at a high velocity through a strong magnetic field so as to cause a voltage to be generated in the gas. The current source is adapted to deliver very high currents, on the order of 10,000 amperes, although the voltage may be relatively low such as 10 volts. Such currents are required to generate a very strong direct magnetic field and create a plasma. Such plasma devices may include additional means for aiding in the initiation of a plasma generation, a cooling means for the torch in the form of annular chamber around the nozzle.

In the plasma process, a gas which is ionized in the torch regains its heat of ionization on exiting the nozzle to create a highly intense flame. In general, the flow of gas through the plasma spray apparatus is effected at speeds at least approaching the speed of sound. The typical torch comprises a conduit means having a convergent portion which converges in a downstream direction to a throat. The convergent portion communicates with an adjacent outlet opening so that the discharge of plasma is effected out the outlet opening.

Other types of torches may be used such as an oxy-acetylene type having high pressure fuel gas flowing through the nozzle. The powder may be introduced into the gas by an aspirating effect. The fuel is ignited at the nozzle outlet to provide a high temperature flame.

Preferably the powders utilized for the torch should be uniform in size, and composition and relatively free flowing. Flowability is desirable to aid in the transportation and injection of the powder into the plasma flame. In general, fine powders (less than 40-micrometers average diameter) do not exhibit good flow characteristics. A narrow size distribution is disirable because, under set flame conditions, the largest particles may not melt completely, and the smallest particles may be heated to the vaporization point. Incomplete melting is a detriment to the product uniformity, whereas vaporization and decomposition decreases process efficiency. Typically, the size ranges for plasma feed powders are such that 80 percent of the particles fall within a 30 micrometer diameter range with the range of substantially all the particles within a 60 micrometer range.

U.S. Pat. No. 3,909,241 to Cheney et al describes a process for preparing smooth, substantially spherical particles having an apparent density of at least 40 percent of the theoretical density of the material. By plasma densifying an agglomerate obtained by spray drying, metals which typically will not alloy in a melt may be intimately mixed in non-equilibrium phases to form a uniform powder composition.

When modified aluminum and alloy powders for powder metallurgical applications are prepared, it is preferable to prepare a powder blend consisting of the base metal or metal alloy components and the appropriate additional refractory materials as a dispersion modifier. The powders are mixed by methods known in the art, such as by V-blending, tumbling or even by milling to obtain suitable particle sizes if size reduction is desired. The mixing of the powder blend should be sufficient to assure a uniform blending of the dispersion modifier in the powder. It is contemplated that the base metal or base metal alloy may be subsequently reacted to form the dispersion modifier.

The stream of entrained molten metal droplets which issues from the nozzle tends to expand outwardly so that the density of the droplets in the stream decreases as the distance from the nozzle increases. Prior to impacting the repellent surface, the stream typically passes through a gaseous atmosphere which tends to cool and decrease the velocity of the droplets. As the atmosphere approaches a vacuum, the cooling and velocity loss is diminished. It is desirable that the nozzle be positioned sufficiently close to the repellent surface so that the droplets are in a molten condition during impact. If the nozzle is too far away, the droplets may solidify prior to impact. If the nozzle is too close the droplets may impinge on previously sprayed molten droplets so as to form a pool of molten material or increase the droplet size. It is generally desirable that the stream flow in a radial direction toward the repellent surface if the surface is curved, and in a normal direction, if the surface is flat.

The repellent surface is preferably a surface that is not wetted by the molten material so as to increase the propensity of the material to form droplets on the surface. The wettability and relative surface energy of molten metal and a surface can be determined by measuring the contact angle between the liquid phase of the molten metal and the surface through the liquid phase. To favor droplet formation it is preferably to have contact angles greater than about ninety degrees. Typical surfaces may include ceramics such as alumina, silicon nitride, quartz; metal surfaces such as aluminum, copper, and inert solids which may be liquid or solid at room temperatures such as dry ice ($CO_2$) or normal ice ($H_2O$). The surfaces are preferably smooth. Molten droplets which impact the repellent surface are fragmented to form molten fragmented portions which are typically at least about one third the volume of the original droplet. After impact, the molten fragmented portions solidify to form the powder of the present invention which has substantially smoothly curvilinear surfaces. The molten fragmented portions may be cooled by contact with the repellent surface or by an atmosphere near the repellent surface. The cooling medium, either repellent surface or atmosphere is preferably below the solidification temperature of the molten material. When a cooling atmosphere is utilized, the fragmented particles may solidify after bouncing or rebounding off the surface. When the repellent surface is the primary cooling medium, the major quenching may occur on or closely adjacent the surface.

It is theorized that the particles tend toward sphericity due to the fact that molten fragments on the surface tend toward sphericity due to the repellent nature of the surface and rebounding molten fragments tend toward sphericity due to the tendency to contract to the smallest surface area consistent with volume. It is believed that the high velocity tends to promote fragmentation of the particles. As droplets impact the surface, the component of velocity in the direction of flight is immediately changed to a velocity component in a direction which is parallel to or at a slight angle to the surface. This force tends to promote fragmentation of the droplets.

It is preferable that the rebounding fragmented molten portions and solidified particles have a component of velocity in a given direction normal to the stream direction so as to remove fragmented portions from the path of oncoming droplets. If the nozzle is stationary with respect to the repellent surface, this may be accomplished by passing an inert gas over the surface at a velocity sufficient to remove fragmented portions. The nozzle or the surface may also be moved relative to each other so as to remove fragmented portions from the oncoming stream of entrained particles. To prevent impingement of droplets on fragmented portions, it is desirable that the previously fragmented droplets be passed out of the range of the oncoming droplets.

FIG. 1 describes an apparatus for carrying out the method of the present invention. There is shown a plasma gun schematically represented at 15. The gun 15 includes a nozzle radially directed at repellent surface 17 which is in the form of a drum. A source of high pressure gas 19 communicates with a powder source 21 for entraining metal powder. The entrained powder is fed to nozzle 15. A source of D.C. powder 23 is electrically connected between the nozzle 15 and the elements 23 for forming plasma 25. After impacting the surface 17, fragmented portions are collected in a container 27. The drum is rotated so as to impart a tangential component of velocity to rebounding particles and remove the fragmented portions 31 from the path of the oncoming entrained droplets.

Figure 2:
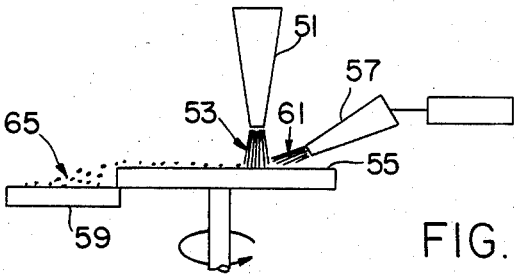
FIG. 2 is a schematic drawing of a device including a plasma spray apparatus, substrate and gas discharge device.

FIG. 2 illustrates another embodiment of the present invention where a nozzle 51 directs a plasma stream 53 against a rotating disc repellent surface 55. Another nozzle 57 is directed at the location of impact so as to direct a stream of inert gas 61 at rebounding fragmented portions 65 which are propelled toward container 59 where collected.

Figure 3:
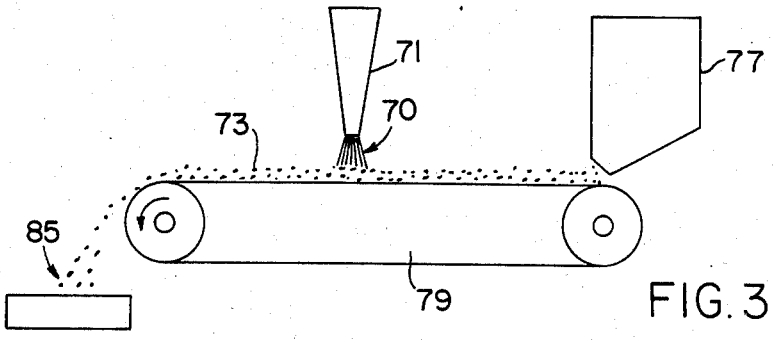
FIG. 3 is a schematic drawing of plasma spray apparatus, endless belt, and discharge device for substrate material.

FIG. 3 illustrates another embodiment where plasma 70 from nozzle 71 is directed against a moving bed of repellent material 75 such as dry ice. The material 75 is deposited from hopper 77 at one end of the moving endless belt 79. The plasma 70 is directed at the moving bed so as to form fragmented portions 85 which are collected in container 81 at the other end of the endless belt 79.

In FIG. 1 through 3 the velocity of the molten droplets in the respective plasma streams 25, 53, 70 is sufficient so that upon impacting respective repellent surfaces 17, 55 and 75 the droplets form fragmented portions. The surfaces 17, 55 and 75 are sufficiently repellent so as to favor droplet formation. Droplets of higher viscosities may require higher velocities for fragmenting droplets.

It is contemplated that a turbulent gaseous medium adjacent repellent surface may aid the solidification of rebounding particles. A turbulent gaseous medium or permitting the rebounding fragmented portions to fall away from the surface under the influence of gravity may enhance the solidification of the fragmented portions away from the surface and thus permit the utilization of less repellent surfaces. The use of a vacuum and permitting fragmented molten portions to fall back onto the repellent surface may enhance the solidification of the fragmented portions on the surface. In this later case, a highly repellent surface may be desirable.

The aluminum powder of the present invention can be compacted and sintered by conventional techniques to produce a densified article. The final article preferably includes a dispersed phase or a discrete phase of additional material uniformly distributed in the aluminum metal matrix. Powdered metallurgical techniques include both simultaneous compacting and sintering and compacting followed by a separate sintering step to produce a densified article. More specifically such techniques include hot pressing or plasma densification. Additional techniques include forming a green shape by injection molding, extruding or slip casting followed by sintering. Injection molding followed by sintering is particularly preferred method of the present invention. According to the above methods, the powder may be mixed with an organic binder to produce a green shape prior to sintering. Additionally, the sintered article may be mechanically worked to obtain further desired metallurgical properties.

EXAMPLE 1

A Baystate, PG120-4, plasma gun is mounted in a chamber about 4 to about 6 inches from a block of dry ice. Agglomerated aluminum powder containing about one atomic weight percent silicon carbide having a size distribution of about 56 percent −270+325 and about 44 percent −325 mesh is fed to the gun at the rate of 8.85 pounds per hour entrained in argon at about 10 cubic feet per hour. The argon plasma gas is fed to the torch at the rate of about 60 cubic feet per hour. The torch power is about 30 volts at 600 amperes. The chamber has a nitrogen atmosphere. The powder is sprayed in a normal direction onto a block of dry ice as the nozzle is moved back and forth over the block. About 85 grams of molybdenum powder is collected. A Scanning Electron Micrograph indicates that about 90 percent of the particles appear to be less than about 10 micrometers. The particles have smooth curvilinear surfaces tending toward sphericity.

EXAMPLE 2

In a manner similar to example 1, aluminum powder containing 2 percent lead by atomic weight percent having a starting size of about 30 to 40 micrometers is reduced to copper particles having a particle size of about 1 to about 10 micrometers. The starting powder has a size distribution of 100 percent less than 270 mesh. The apparatus used is as described in Example 1 except the powder feed rate is 5.7 pounds per hour, plasma gas feed rate is 60 cubic feet per hour, and about 405 grams of the powder is collected. The final powder exhibits the curvilinear structure similar to the powder structure as of Example 1.

EXAMPLE 3

In a manner similar to Example 2, a powder consisting of aluminum, 2 percent lead, and one percent tin is plasma sprayed. The resulting powder which tends toward sphericity has an amorphous metastable structure.

EXAMPLE 4

In a manner similar to Example 1, the dry ice bed is replaced with a ceramic substrate comprising quartz which has a high thermal shock resistance. The substrate surface is smooth and the cooling gas of nitrogen is directed at the surface in the impact area in a direction tangential to the plasma stream. Rebounding fragmented particles which are collected exhibit the spherical powder shape and have an average particle size less than about 10 micrometers.

EXAMPLE 5

An aluminum powder consist of about 8 percent zinc, 2.5 percent magnesium, 1.0 percent copper and 1.5 percent cobalt. The powder was thoroughly blended and formed into an agglomerated powder by spray drying. Spray drying was carried out by pumping the slurry through a nozzle at the top of a commercially available spray dryer. The agglomerated powder was plasma sprayed in the manner set forth in Example 1 to give particles having a particle size and distribution as set forth in Example 1.

EXAMPLE 6

In a manner similar to Example 5, a uniform powder blend containing aluminum as the base metal and silicon carbide in the amount of about one atomic percent was agglomerated and plasma sprayed to yield a uniform powder blend as set forth in Example 5.

EXAMPLE 7

The powders produced according to Examples 1–6 are isotatically pressed into green billets approximately 3 inches in diameter by 4 inches. The billets were presintered in any hydrogen at 1200° C. and vacuum sintered to densities of about 92% of theoretical density. The subsequent billet was heated and forged to a reduced height to yield a hard strengthened material.

We claim:

1. A process for producing a densified aluminum powder comprising forming a flowable agglomerated powder consisting essentially of aluminum and less than 10 atomic weight percent of hardness enhancing additives, entraining said agglomerated powder to a powder in a high pressure gas for transporting said powder to a plasma torch, creating a plasma in said gas and heating entrained powder to a molten condition to form a high velocity stream of molten metal droplets comprising aluminum and an additional discrete phase forming component, said stream being discharged from said torch at a speed greater than 200 meters per second directing said stream toward a repellant surface, fragmenting said molten droplets upon impact with said surface to form molten fragmented portions, rebounding said molten fragmented portions from said surface and cooling said fragmented portions to form a powder comprising particles less than about ten micrometers with smooth surfaces.

* * * * *